US005398274A

United States Patent [19]

Komatani et al.

[11] Patent Number: 5,398,274

[45] Date of Patent: Mar. 14, 1995

[54] FLUORESCENT X-RAY ANALYZER AND MONITORING SYSTEM FOR INCREASING OPERATIVE LIFE

[75] Inventors: Shintaro Komatani; Yoshihiro Wakiyama; Yoshiaki Okada; Yoshinori Hosokawa, all of Kyoto, Japan

[73] Assignee: Horiba, Ltd., Kyoto, Japan

[21] Appl. No.: 2,042

[22] Filed: Jan. 8, 1993

[30] Foreign Application Priority Data

Jan. 12, 1992 [JP] Japan ..... 4-023186

[51] Int. Cl.[6] ..... H05G 1/64

[52] U.S. Cl. ..... 378/98; 378/110

[58] Field of Search ..... 378/98, 111, 112, 113, 378/110

[56] References Cited

U.S. PATENT DOCUMENTS 4,578,767 3/1986 Shapiro ..... 378/111

*Primary Examiner*—Craig E. Church

*Attorney, Agent, or Firm*—Price, Gess & Ubell

[57] ABSTRACT

An improved fluorescent x-ray instrument includes an x-ray tube for generating x-rays, with a control grid regulating the production of x-rays. An operator can set the voltage to be applied to the control grid, and a feedback system will set a desired voltage to the control grid. An operator will be provided an output signal representative of the monitor control grid voltage to enable the operator to determine the operative status of the x-ray tube.

11 Claims, 4 Drawing Sheets

FLUORESCENT X-RAY ANALYZER AND MONITORING SYSTEM FOR INCREASING OPERATIVE LIFE

BACKGROUND OF THE INVENTION

1. Field of the Invention

The present invention relates to a fluorescent x-ray analyzer and, more particularly, to an improved fluorescent x-ray analyzer that can monitor the status of the x-ray tube and thereby increase the effective life of the instrument, while ensuring accurate readings.

2. Description of Related Art

Fluorescent x-ray instruments have been utilized as analytical instruments. Reference can be made to FIG. 4 to disclose a schematic construction of one form of a fluorescent x-ray analyzer. In this regard, a sample can be held on a sample monitoring stage (not shown) and subjected to irradiation from primary x-rays 3 from an x-ray tube 2. As a result, fluorescent x-rays and scattered x-rays 6 are generated at the sample, and a filter 4 is placed before an x-ray detector 5. An output signal from the x-ray detector is processed in a pulse height analyzer (not shown) after suitable amplification to conduct a predetermined analysis.

FIG. 5 discloses one form of construction for controlling the output of the x-ray tube 2. The x-ray tube 7 supports a vacuum and contains a thermal cathode 10 that includes a filament 8 and a cathode 9 that is connected to an appropriate power source so as to generate thermal electrons 11. The cathode 9 is connected through a buffer amplifier 12 to the input terminal 13*a* of a comparator 13. An x-ray tube electric current $I_x$ may flow through a detecting resistance 14 provided on the input side of the buffer amplifier 12, to thereby generate a voltage $V_x$ obtained by converting the x-ray tube electric current $I_x$ into a voltage value. This voltage $V_x$ is input as one signal to the comparator 13.

A target 16 is mounted at the other end of the tube member 7 as an anode, and it is connected with a high-voltage power source 15. An x-ray transmissive window 17 made, for example, of beryllium is formed and provides an output from the tube 7 of the primary x-ray 3. A first grid member 18 is capable of regulating the quantity of thermal electrons 11 that are permitted to collide with the target 16. The quantity of thermal electrons 11 is a function of the x-ray tube electric current $I_x$, and the grid 18 can provide a constant value of control thermal electrons 11. A second grid member 19 is used for contracting thermal electrons before they collide with the target 16 so that the stream of electrons is not excessively expanded and are controlled to be arranged between the thermal cathode 10 and the target 16.

A controlled set value for regulating the x-ray tube electric current $I_x$ can be input by the operator into the other input terminal 13*b* of the comparator 13 as the voltage signal $V_R$. This voltage signal $V_R$ is compared with the voltage signal $V_x$ in the comparator 13 to provide a feedback loop to apply a voltage to the first grid 18 through a level converter circuit 20. As a result, a controlled grid voltage of the first grid 18 can be desirably controlled so as to provide a predetermined x-ray tube electric current $I_x$.

A problem that can impact on the use of fluorescent x-ray instruments has been the stability and life of the x-ray tube 2. The inside of the tube member 7 can deteriorate in degree of vacuum where the thermal cathode 10 can deteriorate to produce an emitting factor of the thermal electrons 11. As a result, the ability to provide constant current control deteriorates, and eventually can become impossible. In the conventional fluorescent x-ray analyzer, it becomes difficult to determine the specific time period in which an x-ray tube becomes inaccurate or its control current starts to deteriorate. As a result, erroneous readings can occur as the quantity of x-rays emitted by the x-ray tube 2 is reduced. As can be appreciated, when the x-ray tube 2 loses its ability to be controlled by the operator, it is necessary to exchange the x-ray tube 2. The life of the x-ray tube 2, however, cannot be readily determined. The prior art has frequently resorted to periodic changes of the x-ray tube 2 to guard against analytical errors. As can be appreciated, however, the life of an x-ray tube 2 could be extended beyond the periodic changing, since the maintenance schedule usually requires a safety factor to avoid erroneous readings. Thus, the cost of x-ray tubes 2 must be increased to cover the wasteful utilization of them in an analytical instrument.

The prior art is still seeking an improved fluorescent x-ray instrument for analytical use.

SUMMARY OF THE INVENTION

An improved fluorescent x-ray instrument utilizes an x-ray tube capable of generating primary x-rays with a control grid that can be regulated by the operator to control the production of the primary x-rays. Voltage is applied to the control grid, and this voltage can be monitored by providing an output signal representative of the monitor control grid voltage to the operator, to thereby enable the operator to determine the operative status of the x-ray tube.

In one embodiment of the invention, an output signal representative of the monitor control grid voltage can be compared with a predetermined reference voltage to determine the operative life of the x-ray tube by providing an indication of such a comparison directly to an operator, for example, through an appropriate warning control light or an alarm.

The present invention therefore provides a fluorescent x-ray tube analyzer that is capable of determining the degree of deterioration and defining a specific exchange time or maintenance cycle of an x-ray tube without affecting the readings of the analytical instrument. By monitoring the control grid voltage, both the degree of deterioration and the exchange time period of the x-ray tube can be easily managed by the operator to increase the effective life of the x-ray tube and lower the operating cost of the instrument. It is possible to provide an appropriate monitoring signal to define a first warning period wherein the x-ray tube should be replaced but is still operative, and a second warning period in which the life cycle of the x-ray tube has deteriorated to a point where it can no longer be reliably utilized in an analytical measurement.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide an improved fluorescent x-ray analyzer and monitoring system.

Figure 5:
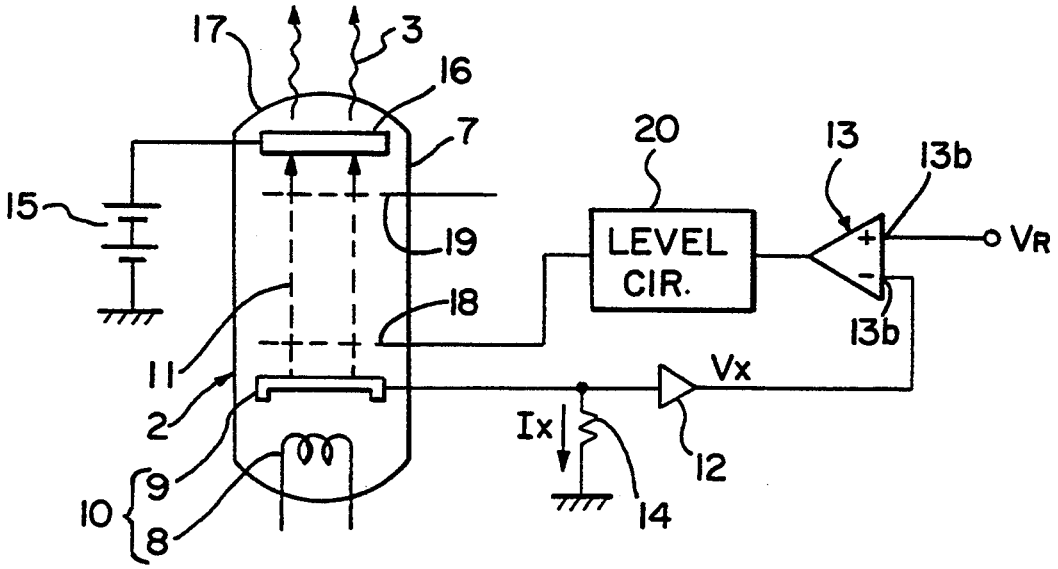
FIG. 5 PRIOR ART
FIG. 5 is a schematic drawing disclosing a circuit for driving a conventional fluorescent x-ray analyzer.
Figure 6:
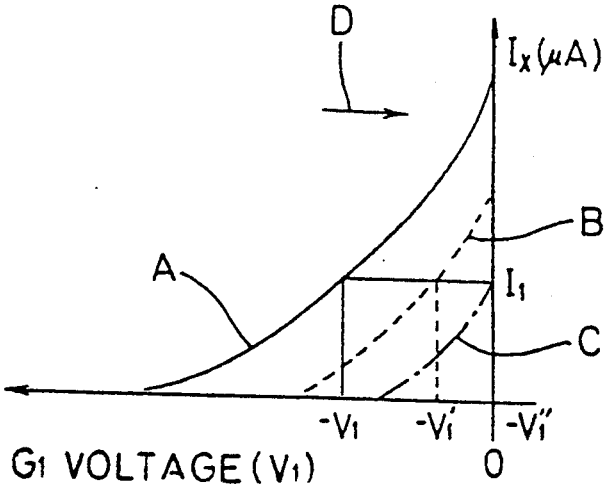
FIG. 6 is an illustrative chart showing a relationship between a grid control voltage $G_1$ and an x-ray tube electric current $I_x$.

To appreciate an application of the features of the present invention, reference is made to FIG. 6, which discloses mutual conversion characteristics (hereinafter referred to as $G_1$-$I_x$ characteristics) between a grid control voltage $G_1$ of a first grid member 18 and an x-ray tube electric current $I_x$. Referring to FIG. 6, an axis of abscissa designates the voltage $G_1$ of the first grid 18, while an axis of ordinate designates the x-ray tube electric current $I_x$. As can be appreciated, the common elements of the x-ray tube are identified with the same reference numbers as shown, for example, in FIGS. 1 and 5. The $G_1$-$I_x$ characteristic curve is expressed by a curve shown by the full line in FIG. 6 during the time period when an x-ray tube 2 is new and fresh and is operated as per its original specifications.

After a substantial period of use, the x-ray tube 2 can deteriorate in degree of vacuum, or the thermal cathode 10 can deteriorate to reduce the emitting factor of the thermal electrons 11. These factors, alone or in combination, can deteriorate the output of the x-ray tube 2, and will result in shifting the curve A shown in FIG. 6 in the direction shown by the arrow D in FIG. 6. As a result, a constant current control can be conducted so that the x-ray tube electric current $I_x$ may be equal to the setting electric current $I_1$, so that the grid control voltage $G_1$ is changed to $-V_1$, $-V_1'$, and $-V_1''$, to thereby gradually approach a zero voltage. As can be appreciated, the constant current control will become impossible over this progressive deterioration.

Figure 1:
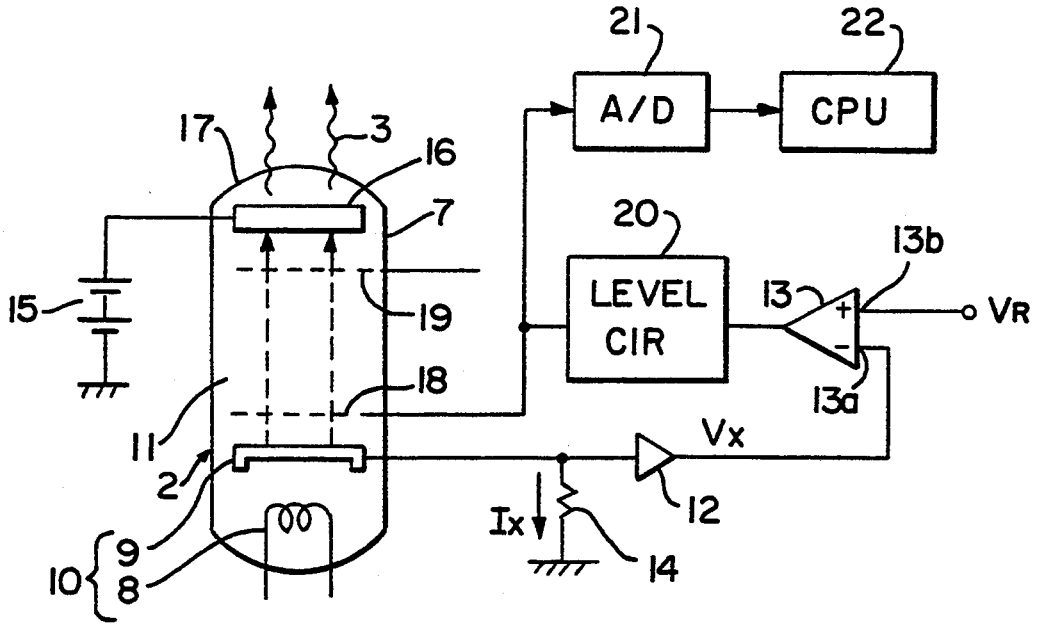
FIG. 1 is a schematic drawing disclosing one construction of the principal components of a fluorescent x-ray analyzer according to one embodiment of the present invention.

Referring to FIG. 1, a schematic drawing of a construction of the present invention for a fluorescent x-ray tube analyzer is disclosed. In this regard, the fluorescent x-ray analyzer is specifically designed to continually monitor the control grid voltage of the grid 18. This can be accomplished in a number of different methods. For example, as shown in FIG. 1, the control grid voltage $G_1$ of the first grid 18 can, through an appropriate I/O circuit (not shown) be converted from an analog to a digital value by an A/D converter 21. The output signal can then be monitored by a CPU or microprocessor-based system 22. In a fluorescent x-ray analyzer having such a construction, the x-ray tube electric current $I_x$ that flows through a detecting resistance 14 from the cathode 9 will generate a detecting voltage $V_x$ across the resistance 14. This voltage signal $V_x$ can be compared with the setting voltage $V_R$ in the comparator 13. The obtained result is fed back to the first grid 18 through a level converter circuit 20.

For example, the level converter circuit 20 can regulate the control grid voltage $G_1$ to the—side when $V_x > V_R$, and to the + side when $V_x < V_R$. The thermal electrons 11 will come into collision with the target 16 as a result of regulating a control grid voltage $G_1$ in the above-described manner to generate the primary x-rays 3, when can then be applied to a sample 1 to conduct the desired analysis.

In operation, the control grid voltage $G_1$ of the first grid 18 is constantly monitored, and a value representative of that voltage is input into the CPU 22 through the A/D converter 21. This value of the control grid voltage $G_1$ can be displayed to an operator in charge of the analysis. Alternatively, if it arrives at a predetermined value such as $-V_1'$ in FIG. 6, an x-ray tube exchange alarm or monitoring warning alarm can be output directly to the operator. If the control grid voltage $G_1$ arrives at a value $-V_1''$ as shown in FIG. 6, a life-ending alarm can be output and the system can be rendered inoperative to avoid any false readings.

Figure 2:
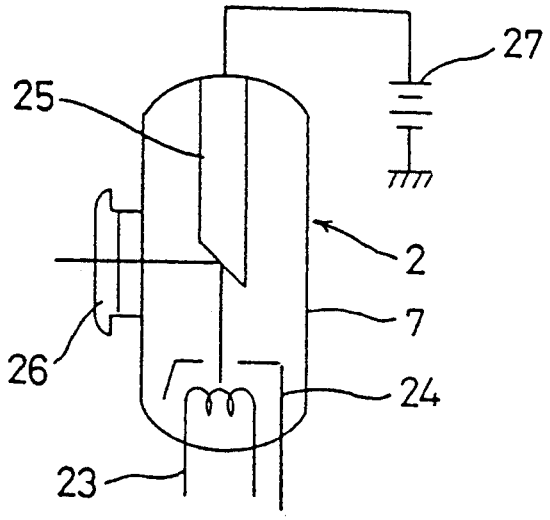
FIG. 2 is a schematic drawing disclosing another example of a construction of an x-ray tube for the present invention.

Although the x-ray tube 2 disclosed is a tetrode transmission type in the above-described preferred embodiment of FIG. 1, it may also be a triode transmission-type tube without a second grid 19, or a reflection-type tube as shown in FIG. 2. Referring to FIG. 2, an alternative embodiment of the present invention can be utilized wherein a filament 23 serves as the thermal cathode and a Wenert's electrode serves as the grid 24. In FIG. 2, the target 25 is positioned adjacent an x-ray transmissive window 26, and a high-voltage power source 27 is applied to the target.

Figure 3:
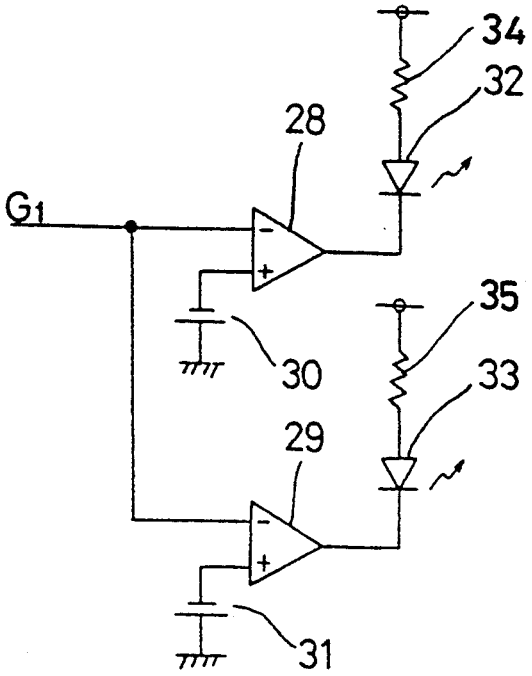
FIG. 3 is an electric circuit disclosing an example of providing an output alarm to an operator.
Figure 4:
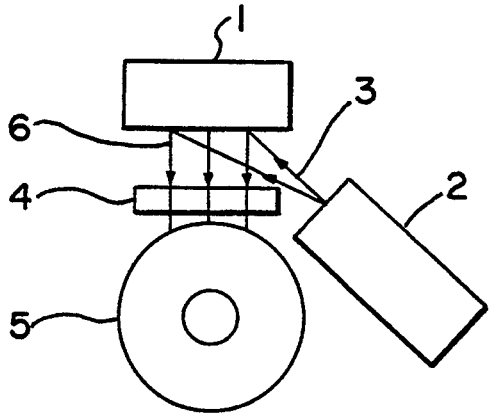
FIG. 4 is a schematic drawing disclosing a prior art fluorescent x-ray analyzer.

Referring to FIG. 3, an alternative embodiment of the present invention can be utilized wherein the control grid voltage $G_1$ is monitored by an analog circuit having two separate comparator circuits 28 and 29, to each output a separate alarm. In FIG. 3, reference numbers 30 and 31 are directed to a standard voltage source, while reference numbers 32 and 33 refer to an LED monitoring light. Reference numbers 32 and 33 refer to resistance values. In this embodiment, if the control grid voltage $G_1$ becomes less than a value determined by the standard voltage source 30, an "x-ray tube exchange alarm" indicator is provided by the LED 32. Further, if the control grid voltage $G_1$ becomes less than a value determined by the standard voltage source 31, a life termination signal for the x-ray tube can be output.

As can be readily appreciated, a number of alarms can be optionally selected to accommodate variations in the above-described embodiments. In addition, in the preferred embodiment shown in FIG. 3, the passive LED alarms 32 and 33 can instead be input to a CPU to provide an on/off signal for the driving of a display device such as a CRT or a liquid crystal display.

Thus, according to the present invention, the degree of deterioration in an accurate exchange maintenance time period for the x-ray tube can be achieved, since the life cycle of the x-ray tube can be readily monitored. Additionally, the x-ray tube can be fully utilized throughout its useful life. Therefore, the costly periodic change to avoid even the possibility of erroneous readings in the analytical measurements can be eliminated. Thus, the quantity of x-rays that are utilized in an analytical measurement can be guaranteed by the utilization of the present invention.

In operation, an improved fluorescent x-ray instrument can monitor the control grid voltage to a specific x-ray tube. The specific type of x-ray tube will have a predetermined grid control voltage and x-ray tube electric current relationship that can be empirically established for a type of x-ray tube. As shown in FIG. 3, a corresponding voltage value can be set as a reference. When the grid voltage reaches that value, an appropriate alarm or warning can be issued to the operator. Thus, an initial alarm can indicate that an x-ray tube is approaching the end of its life, and a subsequent alarm can indicate that the grid voltage has reached a value wherein the quantity of x-rays being produced by the x-ray tube cannot be dependably controlled to meet the needs of the analyzer instrument.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved fluorescent x-ray instrument comprising:

an x-ray tube for generating x-rays, including a control grid for regulating the production of x-rays;

means for providing a variable voltage to the control grid, including an automatic emission level regulator circuit;

means for monitoring the voltage applied to the control grid;

storage means for providing a predetermined voltage value for said x-ray tube representative of the end of its useful life; and comparison means for comparing the monitored control grid voltage and the predetermined voltage value for said x-ray tube to produce an output signal indictive of the operative age of the x-ray tube.

2. The invention of claim 1, further including a first and a second alarm connected to the output signal to respectively provide a warning of approaching the end of the life cycle of the x-ray tube and the actual end of the life cycle of the x-ray tube.

3. The invention of claim 1, wherein the means for providing an output signal includes a computer circuit.

4. The invention of claim 1, wherein the means for providing an output signal includes a comparator circuit and a predetermined voltage signal, wherein the comparator circuit compares the monitored voltage of the control grid with the predetermined voltage signal and provides an output signal when the monitored voltage equals the predetermined voltage signal.

5. An improved fluorescent x-ray instrument comprising:

an x-ray tube for generating x-rays, including a control grid for regulating the production of x-rays;

means for providing a variable voltage to the control grid, including an automatic emission level regulator circuit;

means for monitoring the voltage applied to the control grid;

storage means for providing a predetermined voltage value for said x-ray tube representative of the end of its useful life; and comparison means for comparing the monitored control grid voltage and the predetermined voltage value to determine the operative age of the x-ray tube and for providing an indication of the comparison to an operator.

6. The invention of claim 5, further including a first and a second alarm connected to the comparison means to respectively provide a warning of approaching the end of the life cycle of the x-ray tube and the actual end of the life cycle of the x-ray tube.

7. The invention of claim 5, wherein the comparison means includes a computer circuit.

8. The invention of claim 5, wherein the comparison means includes a comparator circuit and a predetermined voltage signal, wherein the comparator circuit compares the monitored voltage of the control grid with the predetermined voltage signal and provides an output signal when the monitored voltage equals the predetermined voltage signal.

9. An improved fluorescent x-ray instrument comprising:

an x-ray tube for generating x-rays, including a control grid for regulating the production of x-rays;

means for providing a variable voltage to the control grid, including an automatic emission level regulator circuit;

means for monitoring the voltage applied to the control grid;

storage means for providing a predetermined reference signal representative of the control grid voltage at the expiration of the duty cycle of the x-ray tube;

comparison means for comparing the monitored control grid voltage and the predetermined reference voltage to determine the operative age of the x-ray tube and for providing an indication of the comparison to an operator; and a first and second alarm connected to the output signal to respectively provide a warning of approaching the end of the life cycle of the x-ray tube and the actual end of the life cycle of the x-ray tube.

10. An improved fluorescent x-ray instrument comprising:

an x-ray tube for generating x-rays, including a control grid for regulating the production of x-rays;

means for providing a viable voltage to the control grid, including an automatic emission level regulator circuit;

means for monitoring the voltage applied to the control grid;

storage means for providing a predetermined reference signal representative of the control grid voltage at the expiration of the duty life of the x-ray tube;

comparison means for comparing the monitored control grid voltage and the predetermined reference signal to determine the operative age of the x-ray tube; and means for providing and indication of the comparison to an operator.

11. The invention of claim 10, further including a first and a second alarm connected to the comparison means to respectively provide a warning of approaching the end of the life cycle of the x-ray tube and the actual end of the life cycle of the x-ray tube.

* * * * *